United States Patent [19]

Nakajima et al.

[11] 4,013,357

[45] Mar. 22, 1977

[54] COPYING MACHINE IN WHICH, PAPER JAMMING AT COPYING PAPER CUTTING MECHANISM IS PREVENTED

[75] Inventors: Tadanobu Nakajima, Kashihara; Tatsuo Aizawa, Osaka, both of Japan

[73] Assignee: Mita Industrial Company, Ltd., Osaka, Japan

[22] Filed: Aug. 19, 1975

[21] Appl. No.: 605,925

[30] Foreign Application Priority Data

Aug. 23, 1974 Japan ..... 49-96705

[52] U.S. Cl. ..... 355/13; 83/111; 355/29

[51] Int. Cl.[2] ..... G03G 15/00

[58] Field of Search ..... 355/13, 28, 29; 83/111, 83/250, 251

[56] References Cited

UNITED STATES PATENTS

| | | | |
|---|---|---|---|
| 3,707,103 | 12/1972 | Tishken | 83/250 |
| 3,779,641 | 12/1973 | Hauck | 355/13 |
| 3,865,481 | 2/1975 | Washio et al. | 355/13 |
| 3,877,333 | 4/1975 | Illingworth et al. | 83/251 |

*Primary Examiner*—L. T. Hix
*Assistant Examiner*—J. A. LaBarre
*Attorney, Agent, or Firm*—Wenderoth, Lind & Ponack

[57] ABSTRACT

A paper feed device for a copying machine, in which paper jamming at the copying paper cutting mechanism is effectively prevented is provided. This paper feed device for a copying machine comprises a feed reel for supporting a copying paper wound thereon in a roll-like form, a paper feed roller intermittently driven and rotated to take out the copying paper from the feed reel, an introduction roller disposed on the introduction side of a transfer passage for delivering the copying paper to copying treatment zones in the copying machine, and a copying paper-cutting mechanism disposed between the paper feed roller and the introduction roller to cut the copying paper taken out of the feed reel into a prescribed length. The paper feed device further comprises a paper jamming-preventing mechanism for stopping the front end of the copying paper, which is present at the cutting position when the operation of the paper-cutting mechanism is completed, at a position slightly retreated from the cutting position and making the front end of the copying paper stand by for the next copying operation at this retreated position.

6 Claims, 9 Drawing Figures

COPYING MACHINE IN WHICH, PAPER JAMMING AT COPYING PAPER CUTTING MECHANISM IS PREVENTED

BACKGROUND OF THE INVENTION

This invention relates to a copying machine in which paper jamming at the position of a copying paper-cutting mechanism is prevented. More particularly, the invention relates to a copying machine of the type in which a copying paper wound in a roll-like form is cut in a prescribed length by a copying paper-cutting mechanism and fed to copying treatment zones, wherein when the operation of the cutting mechanism is terminated, the front end of the roll-like copying paper is stopped at a position slightly retreated from the cutting position and made to stand by for the next copying operation at this retreated position, whereby paper jamming at the position of the copying paper-cutting mechanism is prevented.

In conventional electrophotographic copying machines, there is broadly adopted a paper feed mechanism in which a copying paper wound in a roll-like form is cut into a length corresponding to the length of an original to be copied and the resulting cut sheet-like copying paper is fed to copying treatment zones in the copying machine. In a copying machine of this type, various kinds of copies differing in the size can be obtained and wasteful consumption of copying paper is prevented. However, this paper feed device of the known conventional copying machine is defective in that paper jamming is often caused at the position of the copying paper-cutting mechanism, and no satisfactory solution of this problem has been provided as yet in the art.

For example, in a cutting mechanism as disclosed in Japanese Utility Model Publication No. 36619/71, a roll-like copying paper is cut simultaneously when the feeding of the roll-like copying paper is stopped. When this cutting mechanism is adopted, however, it is very difficult to stop the copying paper so that the front end of the copying paper falls just on the cutting position with certainty. More specifically, the front end of the copying paper projects slightly from the cutting position because of delay in stopping the feeding of the copying paper or delay of the return of the cutter after the cutting operation; namely, the front end of the copying paper is kept in a condition stuck on the cutter. Accordingly, the copying paper is not fed out at the next copying operation, and hence, paper jamming is often caused in the cutting mechanism.

Japanese Patent Publication No. 5397/71 discloses a cutting mechanism in which driving and rotation of a roller for feeding out a roll-like copying paper is stopped before a cutting mechanism performs its operation, and the copying paper is then fed and delivered by a delivery roller continuously rotated, while the above feed roller is driven idly by the copying paper. In this cutting mechanism, however, paper jamming is similarly caused as in the case of the above-mentioned mechanism by inertia rotation of the feed-out roller caused when the delivery roller is stopped or by other causes.

When paper jamming is caused in the cutting mechanism, a copying paper is not forwarded but is folded, and the folded portion cannot be used, resulting in wasteful consumption of the copying paper and an increase of the copying cost per one copy. Further, in order to remove the jammed and folded portion of the copying paper, it is necessary to take the entire roll-like copying paper from the copying machine, cut off the unusable portion (the more delay in finding the jam, the longer becomes the unusable portion) and then set the copying paper to the machine again. Accordingly, the copying operation is made inefficient by this jamming, and paper jamming is a fatal defect involved in copying machines of the type using a roll-like copying paper.

SUMMARY OF THE INVENTION

We found that in a paper feed device of the above structure for a copying machine, if the front end of a roll-like copying paper, which is present at the cutting position when the operation of a paper-cutting mechanism is completed, is slightly retreated from the cutting position and made to stand by at this retreated position for the next copying operation, paper jamming at the position of the cutting mechanism can be effectively prevented. Based on this finding, we have now completed this invention.

More specifically, in accordance with one aspect of this invention, there is provided a paper feed device for a copying machine which comprises a feed reel for supporting a copying paper wound thereon in a roll-like form, a paper feed roller intermittently driven and rotated to take out the copying paper from the feed reel, an introduction roller disposed on the introduction side of a transfer passage for delivering the copying paper to copying treatment zones in the copying machine, and a copying paper-cutting mechanism disposed between the paper feed roller and the introduction roller to cut the copying paper taken out of the feed reel into a prescribed length. The paper feed device further includes a paper jamming preventing mechanism for stopping the front end of the copying paper, which is present at the cutting position when the operation of the paper-cutting mechanism is completed, at a position slightly retreated from the cutting position and for making the front end of the copying paper stand by for the next copying operation at this retreated position.

In accordance with another aspect of this invention, there is provided an electrophotographic copying machine which comprises a paper feed device for feeding a roll-like copying paper, a copying paper transfer passage including a zone of a charging device, a light exposure zone, a zone of a developing device and a zone of a drying or fixing device in the above recited sequence, a moving frame having a transparent plate for supporting thereon an original to be copied, and an optical system fixed in the machine to optically connect the transparent plate of the moving frame to the light exposure zone of the transfer passage and focus an image of the original supported on the transparent plate onto the copying paper travelling in the light exposure zone. The paper feed device comprises a feed reel for supporting a copying paper wound thereon in a roll-like form, a paper feed roller intermittently driven and rotated by means of a clutch mechanism to take out the copying paper from the feed reel, an introduction roller disposed on the introduction side of the transfer passage, and a copying paper-cutting mechanism disposed between the paper feed roller and the introduction roller to cut the copying paper taken out of the feed reel into a prescribed length. The moving frame includes a light exposure range- and cut length-designating mechanism for designating an optional light exposure range and a cut length of the copying paper corresponding to this light exposure range. A first detecting mechanism is provided in the transfer passage to detect the forward end of the travelling copying paper at a position spaced from the operation position of the copying paper-cutting mechanism by a distance corresponding to a prescribed minimum cut length of the copying paper in the direction of the movement of the copying paper and in proximity of the introduction end of the light exposure zone, and to actuate a first switch means so that the actuation of the first switch means is maintained while the copying paper is travelling. A second detecting mechanism is provided on a moving passage of the moving frame to detect the light exposure range- and cut length-designating mechanism of the moving frame which is travelling along the moving passage of the moving support and to actuate a second switch means, the second detecting mechanism being disposed at such a position that when the moving frame is at a position for initiation of the light exposure step and the light exposure range- and cut length-designating mechanism designates a minimum length of the light exposure range, the second detecting mechanism detects the light exposure range- and cut length-designating mechanism. By actuation of the first switch means, the movement of the moving frame for the light exposure step is initiated and the paper feed roller is released from connection with a drive mechanism therefor by means of the clutch mechanism and is driven idly. By actuation of both the first and second switch means, the copying paper-cutting mechanism is actuated to cut the copying paper in a length corresponding to the light exposure range length of the original to be copied while the copying paper is placed under a certain tension a paper jamming-preventing mechanism is disposed in the paper feed device to stop the front end of the copying paper, which is present at the cutting position when the operation of the paper-cutting mechanism is completed, at a position slightly retreated from the cutting position and make the front end of the copying paper stand by for the next copying operation at this retreated position.

BRIEF DESCRIPTION OF THE DRAWINGS

This invention is applicable to any type of copying machine provided with a cutting mechanism, but the following illustration will be given by reference to electrophotographic copying machines installed with a roll-like copying paper, as shown in the accompanying drawings, in which.

DETAILED DESCRIPTION OF THE INVENTION

Figure 1:
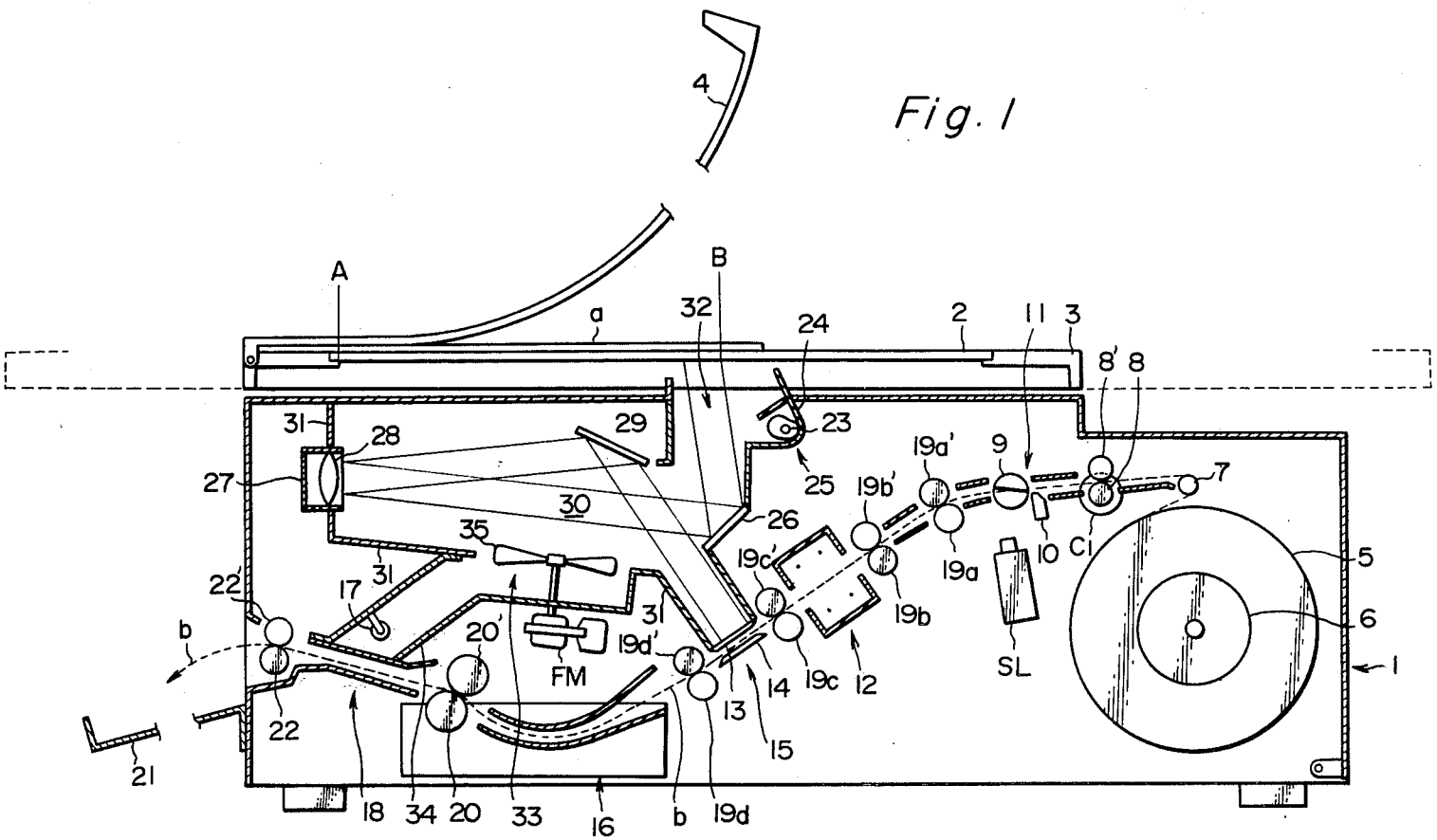
FIG. 1 is sectional view showing the outline of the arrangement of an electrophotographic copying machine to which this invention is applicable.

Referring now to FIG. 1, above a machine frame 1, there is provided, independently from the machine frame 1, a moving frame 3 having a transparent plate 2 for supporting thereon an original *a* to be copied. A pressing plate 4 is mounted on the moving frame 3 to press the original *a* to the transparent plate 2. The moving frame 3 is fitted on the upper portion of the machine frame 1 so that it is moved reciprocatively in the horizontal direction to the left and right on the machine frame 1 by means of a moving frame-driving mechanism (not shown in FIG. 1) having a clutch Ca for movement to the right and a clutch Cb for movement to the left (see FIG. 3). More specifically, simultaneously with initiation of the copying operation, the moving frame 3 is moved to the right in FIG. 1 at a speed higher than the copying paper transfer speed (movement of preparation for the light exposure), and the moving frame 3 is stopped and made to stand by at a position where the forward end A of the original *a* falls just on the position B for initiation of the light exposure step of the original *a* or at a point close to such position. Then, in response to a switch S1 (described below) mounted in the machine the moving frame 3 is moved to the left in FIG. 1 (movement of the light exposure step) synchronously with the copying paper, and after completion of the movement of the light exposure step, the moving frame 3 is returned to the original position indicated by solid lines in FIG. 1.

In the interior of the machine frame 1, there is provided a passage *b* for transfer of a copying paper, which includes a feed reel 6 on which a copying paper 5 is wound in a roll-like form, a guide roller 7 for taking out the roll-like copying paper, a pair of paper feed rollers 8 and 8′ provided with a paper feed clutch C1, a copying paper-cutting mechanism 11 having a rotary blade 9 rotated by a solenoid SL and a fixed blade 10, a zone of a charging device 12, a light exposure zone 15 having a transparent plate 13 for light exposure of a copying paper and a guide plate 14 for guiding and pressing a copying paper to the transparent plate 13, a zone of a developing device 16 and a zone of a drying or fixing device 18 having a heat source 17, these members and zones being arranged in the sequence recited above.

In addition to the foregoing members, on the copying paper transfer passage *b* there are disposed pairs of delivery rollers 19*a* and 19*a*′, 19*b* and 19*b*′, 19*c* and 19*c*′ and 19*d* and 19*d*′, a pair of squeeze rollers 20 and 20′ acting also as delivery rollers and a pair of discharge rollers 22 and 22′ for discharging copies from the machine to a copy receiver 21. These rollers are appropriately spaced from one another and they are always driven so that a copying paper is delivered smoothly.

An optical system is mounted between the copying paper transfer passage *b* and the moving frame 3 in the machine frame 1 so as to optically connect the light exposure zone 15 of the copying paper transfer passage *b* with the transparent plate 2 of the moving frame 3 and focus an image of an original *a* to be copied on a copying paper 5 travelling along the transfer passage *b*. This optical system comprises a light projecting device 25 provided with a light source 23 and a reflection wall 24, a reflection mirror 26, a lens 28 provided with an in-mirror 27, a reflection mirror 29, and a lens housing 31 supporting the mirrors 26 and 29, the lens 28 and the above-mentioned transparent plate 13 in the light exposure zone 15 and forming in the optical system an independent chamber 30. This optical system is so constructed that a light emitted from the light source 23 and reflected on the original *a* passes through reflection mirror 26, lens 28, in-mirror 27 and reflection mirror 29 and arrives at the transparent plate 13 to focus thereon the image of the original *a*.

The lens housing 31 has in the upper portion thereof an illumination opening 32 for illumination of the original *a* and in the lower portion thereof another opening 33. The opening 33 is connected to the zone of the drying or fixing device 18 through an air duct 34 having the abovementioned heat source 17, and a suction fan 35 driven by a fan motor FM is attached to housing 31 at opening 33. When this suction fan 35 is driven, cold air outside the machine is introduced into the chamber 30 of the optical system after it has cooled the transparent plate 2 and the light source 23. The air heated by the heat exchange with the transparent plate 2 and the light source 23 then passes through the air duct 34 and is further heated by the heat source 17 in the air duct 34. Then, the heated air is discharged in the zone of the drying or fixing device 18.

In the electrophotographic copying machine shown in FIG. 1, specific detecting mechanisms are disposed along the copying paper transfer passage *b* and a moving passage (indicated by dotted lines) of the moving frame 3, and the initiation and termination of the movement of the moving frame 3 for preparation for the light exposure step, the initiation and termination of the movement of the moving frame 3 for the light exposure step and the initiation and termination of the return travel of the moving frame 3, and the cutting of a roll-like copying paper are controlled by switch means actuated by these detecting mechanisms.

Figure 2:
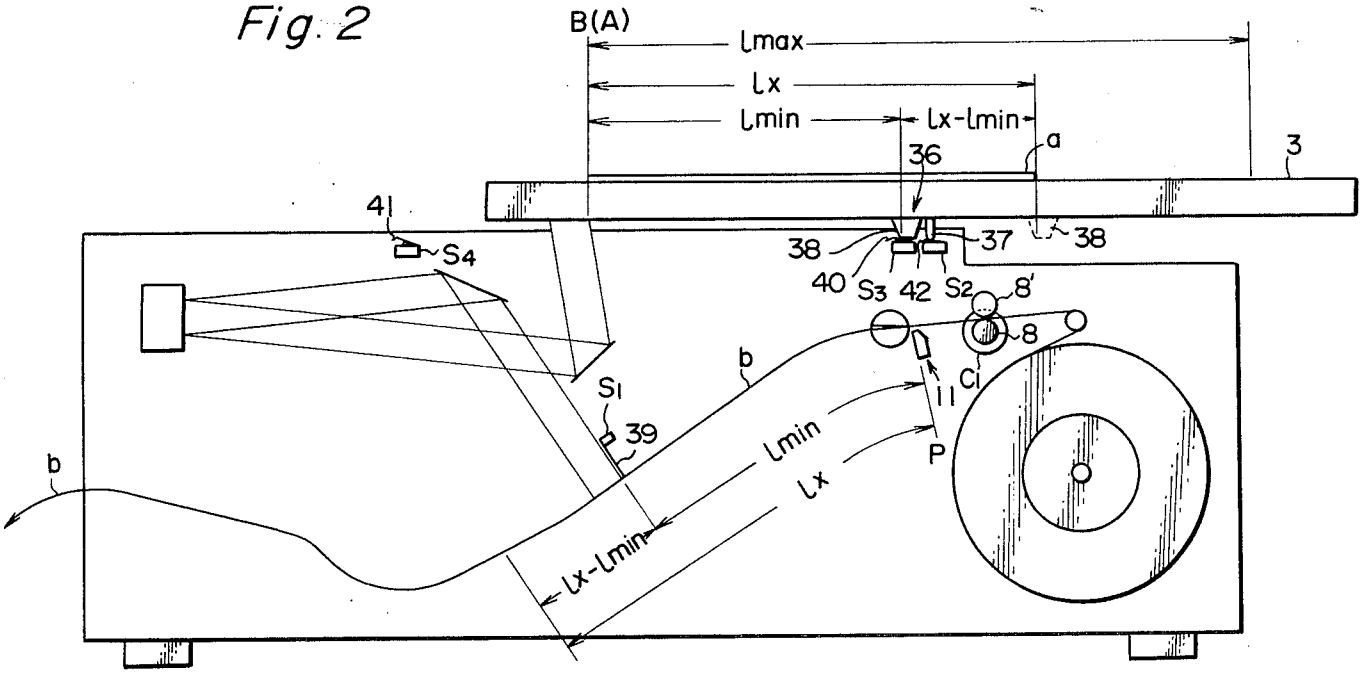
FIG. 2 is a diagram illustrating the arrangement of switch means in the electrophotographic copying machine shown in FIG. 1.

More specifically, in the case of the electrophotographic copying machine shown in FIG. 1, as is illustrated in FIG. 2, a mechanism 36 for designating the light exposure range and corresponding copying paper cut length and a fixed projection 37 are mounted on the side edge portion of the moving frame 3 to determine an optional light exposure range in accordance with the length of the original *a* to be copied and a corresponding copying paper cut length.

The designating mechanism 36 comprises a convex part 38 for pressing push pieces of switches disposed on the moving passage of the moving frame 3, a lever (not shown) for moving the designating mechanism 36, and an indicator (not shown) for deciding the operation range of the designating mechanism 36 according to a dial (not shown) graduated from a minimum light exposure range length mark Mmin to a maximum light exposure range length mark Mmax.

This designating mechanism 36 can be moved along the side edge portion so that the light exposure range length or copying paper cut length *lx* will be optionally chosen within a range of from a minimum light exposure range length or copying paper cut length *l*min to a maximum light exposure range length or copying paper cut length *l*max.

In case a copy having a size equal to an original is obtained, on the copying paper transfer passage *b* a first detecting mechanism comprising a switch S1 and a push piece 39 of switch S1 is disposed at the point or in the vicinity of the introduction end of the light exposure zone 15 and is spaced in the direction of the movement of the copying paper from the actuation point P of the copying paper cutting device mechanism 11, namely the point of initiation of the copying paper transfer, by a distance corresponding to the prescribed minimum cut length *l*min (minimum light exposure range length). The actuating arm 39 detects the forward end of the running copying paper to actuate the switch S1 and the switch S1 is kept closed while the copying paper is moving in pressing contact with the actuating arm 39. When the actuating arm 39 detects the rear end of the copying paper, the switch S1 is returned to the original open state.

On the moving passage of the moving frame 3, another detecting mechanism comprising a switch S3 and an actuating arm 40 of switch S3 is disposed. The actuating arm 40 detects the above-mentioned designating mechanism 36 of the moving frame 3 which is travelling along the passage thereof, to actuate the switch S3. Known detecting mechanisms, for instance, a photoelectric detecting mechanism, can also be used as such detecting mechanism.

This detecting mechanism including the switch S3 is so disposed that when the forward end A of the original *a* on the moving frame 3 is positioned at the point B of initiation of the light exposure step and the minimum light exposure range length *l*min (minimum copying paper cut length) is set in the designating mechanism 36, the convex part 38 of the designating mechanism 36 is detected by its contact with the actuating arm 40. By establishing such positional relationship, it is made possible to cut the copying paper in a length corresponding to the length *lx* of the light exposure range of the original.

Figure 3:
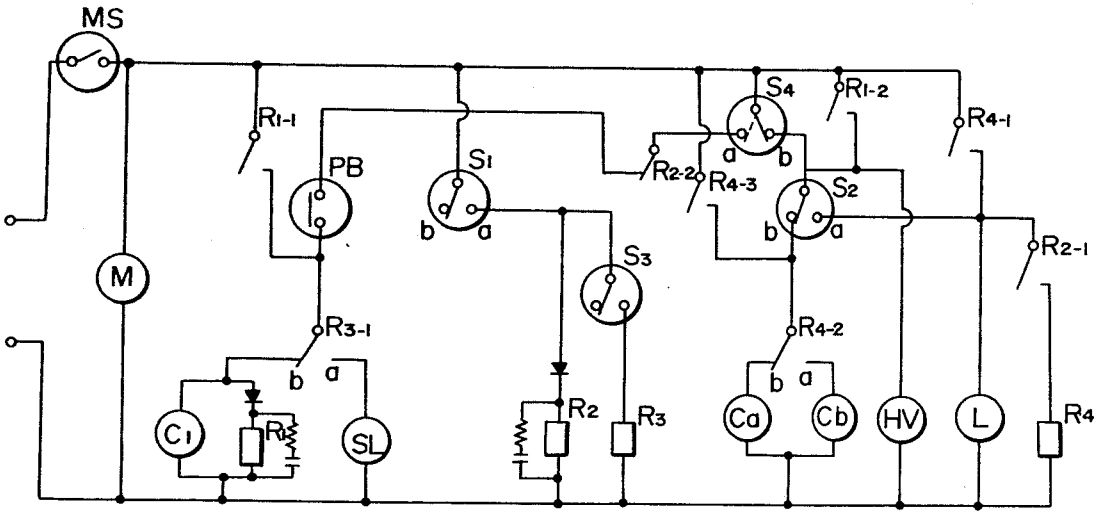
FIG. 3 is a circuit diagram of the electrophotographic copying machine shown in FIG. 1.

In the electrophotographic copying machine shown in FIG. 1, the copying paper cutting mechanism 11 is so arranged that it is actuated only when both the switches S1 and S3 are actuated, namely closed. For embodying this feature, as is illustrated in FIG. 3, switches S1 and S3 and relay R3 are connected to an electric source in series, and a normally open contact *a* of relay contact R3-1 of the relay R3 is connected in series to a cutter solenoid SL, and a paper feed clutch C1 is connected to a normally closed contact *b* of the relay contact R3-1. Thus, when the relay R3 is actuated to energize the cutter solenoid SL, passage of an electric current into the paper feed clutch C1 is stopped. Further, an off-delay relay R1 is disposed in parallel to the paper feed clutch C1 and a self-maintaining contact R1-1 of the relay R1 is connected in series to a common terminal of the relay contact R3-1, so that when the contact *b* of the relay contact R3-1 is opened and the contact *a* is closed, the relay contact R1-1 is kept in the closed state for a time necessary for keeping the cutter solenoid SL in the actuated state. The common terminal of the relay contact R3-1 is connected to the electric source in series through normally closed contacts *a* of switch PB for initiation of the copying operation, normally closed relay contact R2-2 of an off-delay relay R2 and normally closed contact *a* of switch S4.

The mechanism according to which the copying paper 3 is cut into a length *lx* corresponding to an optional light exposure range length *lx* of the original *a* to be copied will now be detailed by reference to FIG. 2.

The length designating mechanism 36 is set to the position of $lx$. At the time of initiation of the copying operation, the copying initiation switch PB is closed to actuate the paper feed clutch C1 to start the feeding of roll-like copying paper. The forward end of the copying paper reaches the introduction end of the copying paper light exposure zone 15 and presses the actuating arm 39 of the first detecting mechanism to actuate the switch S1. At this moment, the distance between the forward end of the copying paper and the actuation point P of the cutting mechanism 11 is equal to the length $l$min, and the moving frame 3 is positioned at the point of initiation of the light exposure step to actuate the switch S2. The forward end A of the original to be copied which is placed on the moving frame 3 and the forward end of the copying paper 5 are introduced from such points into the illumination opening and the light exposure zone, respectively, at synchronized speeds. While the copying paper 5 is passing through the light exposure zone 15, the switch S1 of the first detecting mechanism is kept in the actuated state, namely the switch S1 is kept in the closed state. When the moving frame 3 has travelled the distance of ($lx - l$min), the actuating arm 40 disposed on the moving passage of the moving frame 3 has a contact with the convex part 38 of the designating mechanism 36 to thereby close the switch S3. As is illustrated in FIG. 3, when both the switches S1 and S3 are thus closed, the relay R3 is actuated to close the normally open contact $a$ of the relay contact R3-1, whereby an electric current is passed through the cutter solenoid SL and the copying paper 5 is cut. When the cutting of the copying paper is thus effected, the forward end of the copying paper 5 is spaced from the actuation point of the cutting mechanism 11 by a distance of $l$min + ($lx - l$min), namely a distance of $lx$ as a whole. Accordingly, in the electrophotocopying machine of this invention, it is made possible to cut the copying paper 3 into a length corresponding to the optional light exposure range length $lx$ of the original $a$ to be copied. In short, random cutting of copying paper can be easily performed.

What is important in cutting the copying paper is that the actuating point of the switch S1 and the forward end A of the original to be copied which is placed on the moving frame 3 positioned at the point B of initiation of the light exposure step are in agreement with the introduction ends of the light exposure zone 15 and the illumination opening 32, respectively, or are in the vicinity of these introduction ends, and the time required for the forward end of the copying paper to reach the introduction end of the light exposure zone 15 is equal to the time required for the forward end A of the original to reach the introduction end of the illumination opening 32.

On the moving passage of the moving frame 3, in addition to the above-mentioned switch S3, there are disposed a switch S4 having an actuating arm 41 which is engaged with the projection 37 formed on the moving frame 3 to stop the moving frame 3 which has completed the movement of the light exposure step and is making the return travel, at the stop point (indicated by solid lines in FIG. 1) just above the machine 1, and a switch S2 having an actuating arm 42 which is engaged with projection 37 in the movement of the moving frame 3 for preparation for the light exposure step to stop the forward end A of the original $a$ and make it stand by at the point B for initiation of the light exposure movement or in the vicinity of this point B.

Respective switch means and other members of the electrophotographic copying machine of FIG. 1 are operated in the following manner by an electric circuit illustrated in FIG. 3.

When a print button PB for starting the copying operation is depressed, the relay R1 is actuated to close the relay R1-2, and the clutch Ca for movement in the right direction is energized through the normally closed contact $b$ of the switch S2 and the normally closed contact $b$ of the relay contact R4-2 to cause the moving frame 3 to make the movement for preparation for the light exposure step. When the projection 37 presses the actuating arm 42 of the switch S2, the normally closed contact $b$ of the switch S2 is opened and the clutch Ca is de-energized to stop the moving frame 3.

Simultaneously when the moving frame 3 thus completes the movement for preparation for the light exposure step, or in the state where the front end A of the original $a$ on the moving frame 3 is stopped at the position B of initiation of the movement of the light exposure step, the front end of the copying paper 5 presses the actuating arm 39 of the switch S1 to close the normally open contact $a$ of the switch S1, whereby the off-delay relay R2 is actuated to close the normally open relay contact R2-1 and the relay R4 is energized through the normally open contact $a$ of the switch S2 and the relay contact 2-1.

When the relay R4 is thus actuated, the normally open contact $a$ of the relay R4-2 is closed and the normally open relay contact R4-3 is closed. Accordingly, an electric current is applied to the clutch Cb for movement in the left direction (movement in the positive direction) through the relay contact R4-3 and the normally open contact $a$ of the relay contact R4-2, and the movement of the moving frame 3 for the light exposure step (the movement in the positive direction) is initiated. Since the relay R4 has a self-retention contact R4-1, even if the contact $a$ of the switch S2 is opened by the movement of the moving frame 3 in the positive direction, the relay R4 is kept energized.

When the rear end of the copying paper passes through the actuating position of the actuating arm 39 of the switch S1, the relay R2 is opened and by the off-delay activity of the relay R2, the relay contact R2-1 is opened at the point when the rear end of the copying paper 5 completes the passage through the light exposure zone. As a result, the relay R4 is opened to de-energize the clutch Cb, and the light exposure step is thus completed and simultaneously, the clutch Ca for movement in the right direction is energized to initiate the return travel of the moving frame 3. When the projection 37 presses the actuating arm 41 of the switch S4 in the return travel of the moving frame 3, the normally open contact $a$ of the switch S4 is closed to de-energize the clutch Cb and stop the moving frame 3 at the stop point.

One of important features of this invention is that in a copying machine of the above structure, the front end of the copying paper 5, which is present at the cutting position P when the operation of the copying paper-cutting mechanism 11 is terminated, is stopped and made to stand by at a position slightly retreated from the cutting position P, whereby projection of the front end of the copying paper 5 from the cutting position by delay in stopping of the paper feed rollers 8 and 8', or inertia rotation thereof or striking of the front end of the copying paper 5 over the rotary blade 9 of the cutting mechanism 11 is prevented and in turn, paper jamming is effectively prevented from occurring.

Various mechanisms can be adopted for stopping the front end of a roll-like copying paper at a position slightly retreated from the cutting position P and making it stand by at this retreated position. In accordance with one preferred embodiment of this invention, there is disposed a paper jamming-preventing mechanism for rotating the paper feed roller by a small angle in a direction reverse to the normal paper-feeding rotation direction when the operation of the cutting mechanism is completed, whereby the front end of the roll-like copying paper, which is present at the cutting position when the cutting operation is completed, is stopped and made to stand by at a position slightly retreated from the cutting position.

Figure 4:
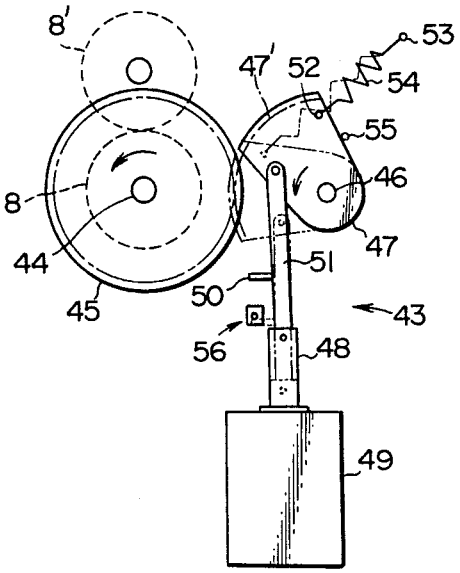
FIG. 4 is a side view showing main members of one embodiment of the paper jamming-preventing device of this invention.

In FIG. 4 illustrating one embodiment of the paper jamming-preventing mechanism of this type, paper jamming-preventing mechanism 43, namely a mechanism 43 for retreating the front end of the copying paper by reversing the rotation of the feed rollers 8 and 8′, comprises, in general, a reverse rotation drive mechanism 47 for driving and rotating the feed roller 8 only by a small angle in the direction (clockwise direction) reverse to the direction (counterclockwise direction) of the normal paper-feeding rotation, and control mechanisms 49, 54 and 56 for connecting reverse rotation drive mechanism 47 with the paper feed roller 8 just after cutting of the copying paper to rotate the feed roller 8 by a small angle in the reverse direction and stop the feed roller 8 at this slightly reversed position and for releasing the connection between the reverse rotation drive mechanism 47 and the feed roller 8 when the paper feed roll 8 is rotated in the normal paper-feeding direction through the paper feed clutch C1.

This reverse rotation drive mechanism 47 comprises, for example, an angle gear rotatably fitted to a shaft 46 fixed to a machine frame (not shown), and teeth 47′ of the angle gear 47 are arranged so that they are engaged with a spur gear 45 fitted to one of shafts of the rollers 8 and 8′, preferably the shaft 44 of the roller 8 on the driving side, when the angle gear 47 is rotated.

The above-mentioned control mechanisms include an elastic member 54 for urging the angle gear 47 to a position not engaged with a paper feed roller gear 45 while the paper feeding operation is continued, a solenoid mechanism 49 and a link mechanism 51 for rotating the angle gear 47 about shaft 46 against elastic member 54 at the time of completion of the cutting operation to thereby engage the angle gear 47 with the paper feed roller gear 45 and rotating the paper feed roller 8 by a small angle in the reverse direction, and a restraint mechanism 56 for restraining the angle gear 47 at the rotated position against the tensile force of the elastic member 54, such restraining force being yielded to the driving force when the paper feed roller 8 is driven by a normal rotation drive mechanism (not shown) actuated by the paper feed clutch C1, whereby the restraint of the angle gear 47 is released.

The solenoid 49 has a plunger 48 which is moved vertically by an electromagnetic force, and one end of a connecting member 51 is pivotally attached to the plunger 48 and the other end of the connecting member 51 is pivotally attached at a position spaced from the shaft of the angle gear 47. During the normal operation, namely while the paper feed rollers 8 and 8′ are rotated in the normal paper-feeding rotation, the angle gear 47 is contacted with a contact pin 55 fixed to the machine frame by the force of a spring 54 disposed between a pin 52 fixed to one end of the angle gear 47 and a pin 53 fixed to the machine frame, and therefore, the angle gear 47 is kept stationary at the position not engaged with the gear 45. When the plunger 48 is attracted by the solenoid 49, the angle gear 47 is rotated in the direction indicated by an arrow to the position indicated by a two-dot chain line against the force of the spring 54. The restraint mechanism 56 is disposed on a moving passage of a projection 50 formed on the connecting member 51 so that it is engaged with projection 50 to stop the angle gear 47 at the rotated position.

Figure 5:
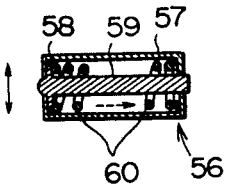
FIG. 5 is a sectional view of the restraint mechanism of the device shown in FIG. 4.

The restraint mechanism 56 has in the interior thereof, as shown in an enlarged view of FIG. 5, a restraint rod 59 including a contact plate 58 in a casing 57 and a spring 60 for pressing the contact plate 58 to the casing 57 so that the top end of the restraint rod 59 is projected from the casing 57 and engaged with the projection 50 of the connecting member 51. When a force is imposed on the portion of the restraint rod 59 projected from the casing 57 in a direction indicated by a solid line arrow, the restraint rod 59 is moved to a direction indicated by a dotted line arrow against the force of the spring 60 and the top end of the rod 59 is allowed to cave in the casing 57, whereby the restraint is released. The force of the spring 60 is made stronger than the force of the spring 54 imposed on the angle gear 47 but is made weaker than the driving force of the paper feed rollers 8 and 8′ and the attracting force of the solenoid 49.

When an electric current is applied to the solenoid 49 and the plunger 48 is attracted, the angle gear 47 is rotated against the force of the spring 54 through the connecting member 51 to the position indicated by a two-dot chain line into engagement with the gear 45, whereby the paper feed rollers 8 and 8′ are rotated in the reverse direction by a prescribed angle to retreat the copying paper from the cutting position P of the cutting mechanism 11 by a prescribed distance.

In the foregoing embodiment of the paper jamming-preventing mechanism, in order to appropriately set the time of initiation of the operation of the paper jamming-preventing mechanism 43 for retreating the front end of the copying paper, the solenoid 49 is so arranged that it is actuated with a certain time lag behind actuation of the cutter solenoid SL of the copying paper-cutting mechanism 11.

Figure 6:
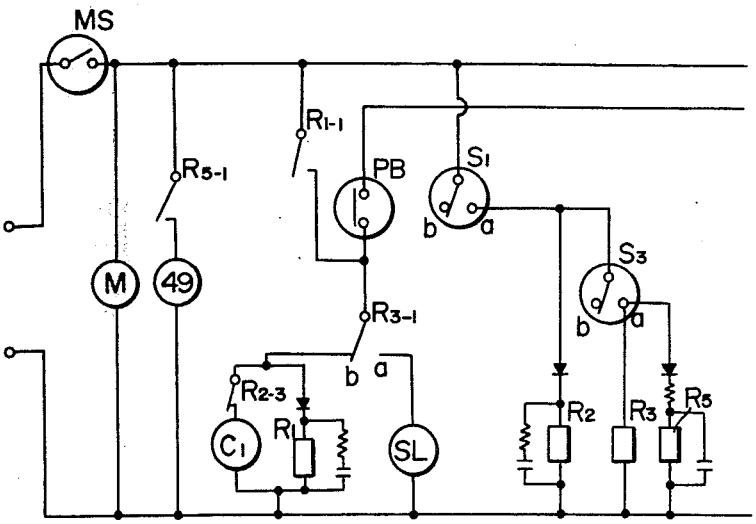
FIG. 6 is a simplified circuit diagram of the mechanism actuating the device shown in FIG. 4.

To embody this feature, as shown in FIG. 6, an on-delay relay R5 is connected in series to the above-mentioned switches S1 and S3, and the above solenoid 49 is connected to a power source through a normally open contact R5-1 of the relay 5. When both the switches S1 and S3 respectively are depressed and the relay R3 is energized, also the on-delay relay R5 is simultaneously energized. Accordingly, when in the relay contact R3-1, the normally closed contact *b* is opened and the normally open contact *a* is closed, the cutter solenoid SL is actuated to perform the cutting operation, and after passage of a short time, the on-delay relay contact R5 is actuated to close the relay contact R5-1 and the solenoid 49 is actuated.

When the pressing of the actuating arm 40 of the switch S3 is released, the relay contact R5-1 is opened and the solenoid 49 is de-energized but since the projection 50 of the connecting member 51 is engaged with the top end of the restraint rod 59 and the force of the spring 60 imposed on the restraint rod 59 is stronger than the force of the spring 54 for returning the angle gear 47 to the original position, the angle gear 47 is kept stationary at the position indicated by a two-dot chain line.

When the rotation of the paper feed rollers 8 and 8' is resumed (the paper feed clutch C1 is energized again), the gear 45 is rotated so that the angle gear 47 kept stationary in the state engaged with the gear 45 is rotated and returned to the original position. At this time, the restraint rod 59 restraining the projection 50 is caused to cave in by the driving force of the paper feed rollers 8 and 8' imposed on projection 50 and hence, the angle gear 47 is rotated and the engagement with the gear 45 is released. Then, the angle gear 47 is rotated by the force of the spring 54 until it is in contact with the contact pin 55.

In the electric wiring diagram shown in FIG. 6, the paper feed clutch C1 shown in the circuit diagram of FIG. 3 is connected to the normally closed contact *b* of the relay contact R3-1 through the normally closed relay contact R2-3 of the relay R2 connected to the normally open contact *a* of the switch S1, and when the front end of the copying paper presses the actuating arm 39 of the switch S1 to close the normally open contact *a* of the switch S1, the relay R2 is energized. When the relay R2 is actuated, the relay contact R2-3 is opened to de-energize the paper feed clutch C1 and stop the transmission of the driving force to the paper feed rollers 8 and 8'. Then, the actuating arm 40 of the switch S3 is depressed and the relay R3 is actuated to close the normally open contact *a*, whereby the cutter solenoid SL is energized to perform the cutting operation. More specifically, prior to the actuation of the cutting mechanism 11, the driving and rotation of the paper feed rollers 8 and 8' is stopped, and the rollers 8 and 8' are then driven idly but the transfer of the copying paper 5 is continued by the delivery rollers 19*a* and 19*a'*. By this arrangement, deviation of the stop position of the front end of the copying paper can be reduced and hence, the range of the rotation of the angle gear 47 can be set very easily and paper jamming in the cutting mechanism 11 can be prevented assuredly.

As pointed out hereinabove, the switch S3 is arranged so that it is actuated after passage of a short time from actuation of the switch S1. To embody this feature, the switch S1 is disposed upstream of the introduction end of the light exposure zone 15 at a position spaced from this introduction end by a prescribed distance, and the position of the switch 53 is deviated in accordance with this positional arrangement of the switch S1 (see FIG. 9).

In another embodiment of the paper jamming-preventing mechanism 43 for retreating the front end of the copying paper, the above-mentioned restraint mechanism 56 is not provided, but an arrangement is made so that the solenoid 49 is de-energized when a sufficient time has passed from de-energization of the cutter solenoid SL, and the angle gear 47 is rotated from the position indicated by a two-dot chain line to the original position while rotating the paper feed rollers 8 and 8' in the same direction as the direction of the normal paper-feeding rotation. Namely, the intended object of this invention, namely prevention of paper jamming in the cutting mechanism 11, can be effectively attained even if, after the front end of the copying paper has been retreated from the cutting position P and the rotary blade 9 of the cutting mechanism 11 has rotated to return to the original position, the front end of the copying paper is advanced to a position close to the cutting position P.

It is also possible to keep the solenoid 49 in the energized state until the paper feed rollers 8 and 8' are rotated again and to de-energize the solenoid 49 simultaneously with resumption of rotation of the paper feed rollers 8 and 8' (actuation of the paper feed clutch C1).

In this invention, as pointed out hereinabove, it is important that when the operation of the cutting mechanism 11 is completed, the front end of the copying paper, which is present at the cutting position P, is stopped and made to stand by at a position retreated from the cutting position. This can be attained with certainty by adopting the mechanism of the above embodiment in which the paper feed rollers 8 and 8' are rotated in a direction reverse to the direction of the normal paper-feeding rotation.

In another preferred embodiment of this invention, as the paper jamming-preventing mechanism there is employed a copying paper transfer passage-regulating mechanism arranged to form two copying paper transfer passages differing in the passage length between the paper feed rollers 8 and 8' and the copying paper-cutting mechanism 11. More specifically, the cutting mechanism 11 is actuated while the roll-like copying paper is transferred along the shorter passage of the above transfer passages, and after cutting of the copying paper, the copying paper is shifted to the longer passage. Thus, the front end of the copying paper can be stopped and made to stand by at a position retreated from the cutting position P by a distance corresponding to the difference of the length between the two transfer passages.

In this embodiment, it is preferred that the paper feed clutch C1 be de-energized prior to cutting of the copying paper; while the paper feed rollers 8 and 8' are driven, the roll-like copying paper be moved along the longer transfer passage by the driving force of the rollers 8 and 8' imposed on the copying paper; and that when the paper feed clutch C1 is de-energized and the paper feed rollers 8 and 8' are driven idly because of the disengagement with the driving mechanism, the copying paper be moved along the shorter transfer passage by the tension imposed on the copying paper.

Figure 7:
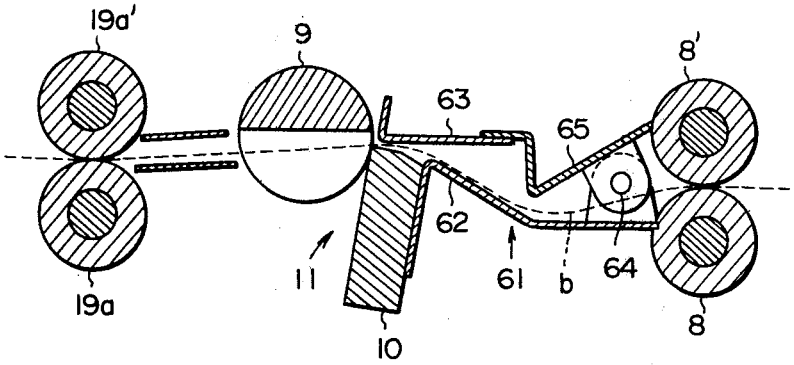
FIG. 7 and FIG. 8 are sectional diagrams illustrating the operation of another embodiment of the device of this invention.

One specific embodiment of the paper jamming-preventing mechanism of this type will now be described by reference to FIG. 7.

The copying paper transfer passage-regulating mechanism 61 is disposed between the copying paper-cutting mechanism 11 and the paper feed rollers 8 and 8'. This regulating mechanism 61 comprises a lower guide plate 62 having an inner face outwardly convex to a line connecting the nip point of the paper feed rollers 8 and 8' and the cutting position P and being fixed to the fixed blade 10 of the cutting mechanism 11, an upper guide plate 63 fixed to the machine frame and a regulating plate 65, one side of which is pivoted on the lower guide plate 62 through a shaft 64 so that it can swing across such line.

Figure 8:
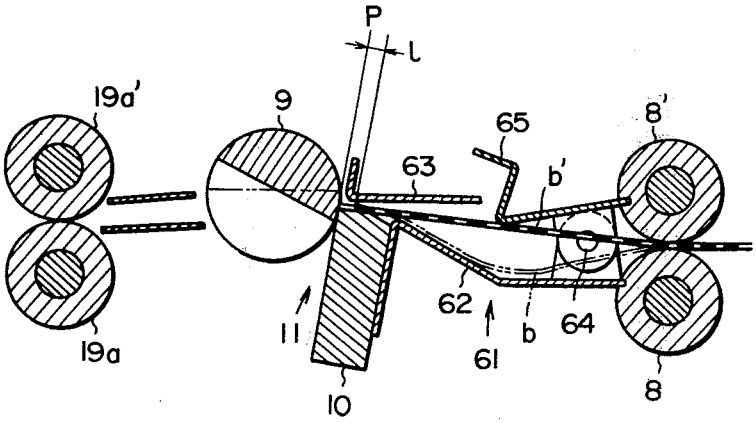

Under normal operation, namely while the paper feed rollers 8 and 8' are driven and rotated by the paper feed clutch C1, the other side of the regulating plate 65 is lowered by gravity and is present at a position having a contact with one end of the upper guide plate 63 acting as a receiving member. In this state, the regulating plate 65 allows the copying paper to move along the longer transfer passage *b* and delivers it to the delivery rollers 19*a* and 19*a'* which are continuously rotated on the discharge side of the cutting mechanism 11. The paper feed rollers 8 and 8' are so arranged that when the driving and rotation of the rollers 8 and 8' are stopped on receipt of a signal transmitted from the switch S1, the rollers 8 and 8' are driven idly by the movement of the roll-like copying paper, and the force of driving the copying paper on the passage *b* is now given by the delivery rollers 19*a* and 19*a'*. Accordingly, when the driving and rotation of the rollers 8 and 8' is stopped, the copying paper 5 is pulled to push up the regulating plate 65 before idle rotation is caused in the paper feed rollers, whereby the copying paper 5 is shifted from the longer transfer passage *b* to the shorter transfer passage *b'* as illustrated in FIG. 8. Thus, the copying paper is delivered in the tensioned state between the paper feed rollers 8 and 8' and the delivery rollers 19*a* and 19*a'* through the cutting mechanism 11.

In this embodiment, the copying paper transfer passage-regulating mechanism 61 is disposed to form two transfer passages *b* and *b'*, and it is important that the transfer passage *b* is longer than the transfer passage *b'* in the arrangement shown in the drawings.

In the embodiment illustrated in FIG. 8, while the copying paper 5 is delivered on the transfer passage *b'*, by cutting instructions given by the switches S1 and S3, the rotary blade 9 of the cutting mechanism 11 is rotated from the position indicated by a two-dot chain line to a position indicated by a solid line and cuts the copying paper 5 at the cutting point P. After the cutting operation, the cut sheet-like copying paper having a length corresponding to the length of the original *a* to be copied is delivered to a next treatment zone, the charging device 12, by the delivery rollers 19*a* and 19*a'*. On the other hand, the roll-like copying paper 5 having the front end present at the cutting position P and being present on the passage *b'* is brought down because the tensile force on the copying paper is released simultaneously with the actuation of the cutting mechanism 11 and the regulating plate 65 which has been pushed up by the tensile force on the copying paper is allowed to fall by gravity until it comes into contact with the upper guide plate 63. The copying paper 5 is further dropped by gravity until it falls on the lower guide plate 62 and is positioned on the transfer passage *b*. At this point, the front end of the copying paper 5 is stopped and made to stand by at a position retreated and spaced upstream from the cutting point P by a length *l* corresponding to the difference in length between the longer transfer passage *b* and the shorter transfer passage *b'*, and when the paper feed rollers 8 and 8' are driven and rotated again for the next copying operation, the copying paper is transferred on the transfer passage *b*.

The difference *l* in length between the transfer passages *b* and *b'* is not particularly critical, and the intended object can be attained sufficiently if only the difference *l* is such that when the copying paper 5 is shifted from the transfer passage *b'* to the transfer passage *b* by the regulating plate 65 and gravity, the front end of the copying paper is stopped and made to stand by at a position retreated and spaced from the cutting position P. Further, the length and shape of each transfer passage are not particularly critical.

In the above embodiment, when the front end of the copying paper is retreated by the copying paper transfer passage-regulating mechanism 61, the driving and rotation of the paper feed rollers 8 and 8' is stopped prior to actuation of the cutting mechanism 11, and after the copying paper 5 has been shifted from the transfer passage *b* to the transfer passage *b'* to maintain it under tension, the cutting operation is conducted, whereby the front end of the copying paper 5 is effectively retreated from the cutting position after the cutting operation. However, it is not always necessary to maintain the copying paper 5 under tension at the time of cutting. More specifically, even when the copying paper is cut while it is shifted being from the passage *b* and is in the tensioned state, the intended object can be attained as long as there is such a difference in length between the transfer passages *b* and *b'* as will allow retreating of the front end of the copying paper from the cutting position P.

Figure 9:
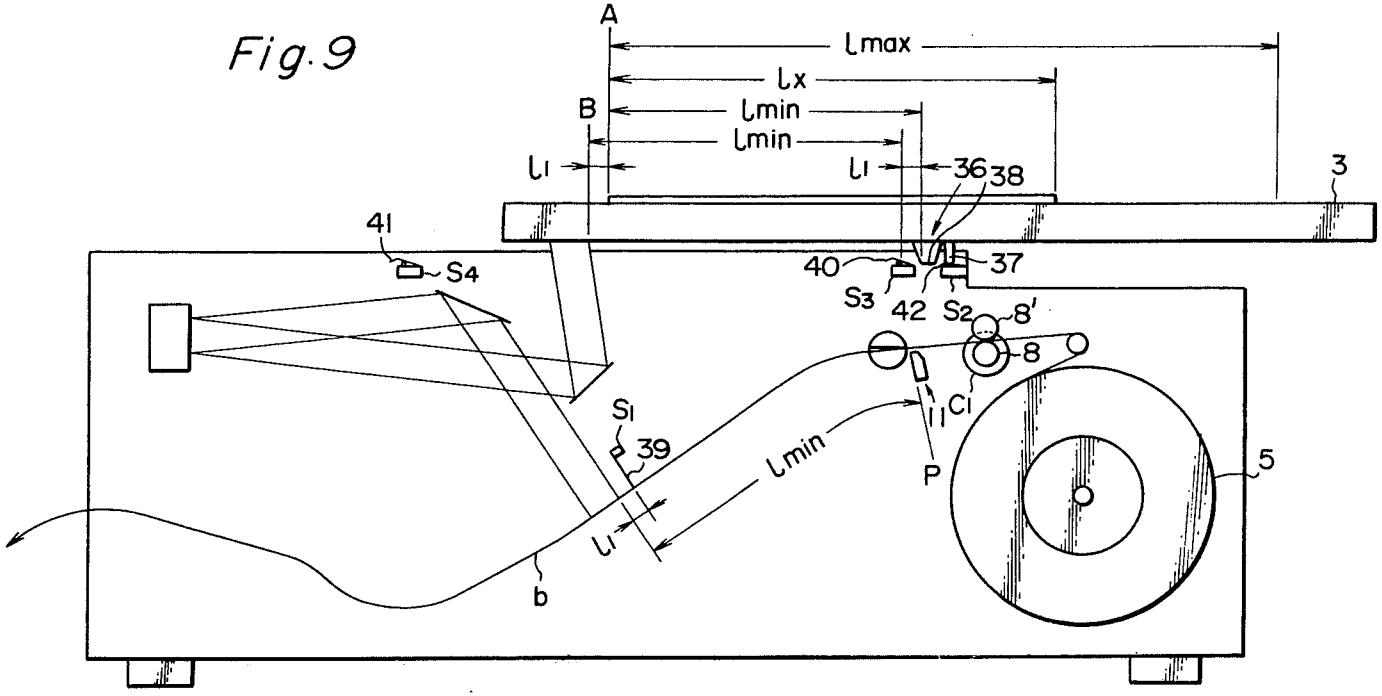
FIG. 9 is a diagram illustrating the arrangement of the switch means in an electrophotographic copying machine provided with the paper jamming-preventing device of this invention.

In the copying machine shown in FIG. 1, as pointed out hereinbefore, the length of the copying paper transfer passage *b* between the cutting position P and the introduction end of the light exposure zone 15 is arranged to correspond to a minimum cut length. Accordingly, when it is intended to cut the copying paper in this minimum length, it is necessary to stop the driving and rotation of the paper feed rollers 8 and 8' prior to the cutting operation and perform the cutting operation when the front end of the copying paper 5 reaches the introduction end of the light exposure zone 15. In order to satisfy this requirement, the switch S1 is disposed at a position spaced upstream from the introduction end of the light exposure zone 15 by a distance *l*1 as shown in FIG. 9. In order to effectively retreat the front end of the copying paper from the cutting point P, it is preferred that this distance *l*1 is set so that the time required for the front end of the copying paper to travel this distance *l*1 is equal to or slightly longer than the time required for the copying paper 5 to be shifted under tension from the passage *b* to the passage *b'* after stopping of the driving and rotation of the paper feed rollers 8 and 8'.

The above-mentioned switch S1, when actuated, performs not only the operation of instructing the stopping of the driving and rotation of the feed rollers 8 and 8' but also the operation of instructing the moving frame 3 stopped and standing by at the light exposure-initiating point B to start movement for the light exposure. Accordingly, only by retreating the switch S1 by the distance *l*1, is there brought about a deviation corresponding to the distance *l*1 between the front end of the original *a* to be copied and the front end of the copying paper. If the switch S2 is disposed at a position retreated by a distance *l*1 so that the front end A of the original *a* is stopped and made to stand by at a position retreated from the light exposure movement-initiating position B by the distance *l*1, the above deviation is eliminated and a print having the same length as that of the original *a* can be obtained.

The above-mentioned copying paper transfer passage-regulating mechanism 61 has a simpler structure than that of the mechanism 43 for retreating the front end of the copying paper, which has been illustrated in the preceding embodiment, and accordingly, the regulating mechanism 61 of this embodiment can be provided at a very low cost and is advantageous from a practical viewpoint.

As is apparent from the foregoing illustration, in this invention, by retreating the front end of the copying paper, which is present at the cutting position at the time of the cutting operation, so that the front end of the copying paper is stopped and made to stand by at a position slightly retreated from the cutting position, it is possible to accurately prevent paper jamming in the cutting mechanism, whereby wasteful consumption of the copying paper is prevented and the copying operation can be performed at a high efficiency with little time loss caused by paper jamming. Accordingly, this invention makes a great contribution to the art.

What we claim is:

1. A paper feed device for a copying machine, said device comprising:

a feed reel for supporting a copying paper wound thereon in a roll-like form;

a paper feed roller intermittently driven and rotated to take out said copying paper from said feed reel;

an introduction roller disposed on the introduction side of a transfer passage for delivering said copying paper to copying treatment zones in the copying machine;

a copying paper-cutting mechanism disposed between said paper feed roller and said introduction roller to cut said copying paper taken out of said feed reel into a prescribed length;

paper jamming-preventing mechanism means for stopping the front end of said copying paper, which is present at the cutting position when the operation of said paper-cutting mechanism is completed, at a position slightly retreated from said cutting position and for making the front end of the copying paper stand by for the next copying operation at this retreated position;

said paper feed roller having a clutch mechanism means for connecting said paper feed roller to a drive mechanism for normal rotation at the start of feeding of said copying paper and for releasing the connection between said paper feed roller and said drive mechanism at the time of cutting the copying paper;

said paper jamming-preventing mechanism means including a reverse rotation drive mechanism means for driving and rotating said paper feed roller by a small angle in a direction reverse to the direction of the normal paper-feeding rotation; and control mechanism means for connecting said paper feed roller to said reverse rotation mechanism means just after the cutting operation to rotate said paper feed roller by said small angle and stop said paper feed roller at the thus obtained slightly reversed position and for disconnecting said paper feed roller from said reverse rotation drive mechanism means while said paper feed roller is connected to said normal rotation drive mechanism.

2. A device as claimed in claim 1, wherein said reverse rotation drive mechanism means comprise an angle gear rotatably fitted to a machine frame and disposed so that it can be engaged with a gear fixed to said paper feed roller; and said control mechanism means includes an elastic member for urging said angle gear to a position out of engagement with said paper feed roller gear while the paper feeding operation is continued, a solenoid mechanism and a link mechanism for rotating said angle gear against said elastic member at the time of completion of the cutting operation to thereby engage said angle gear with said paper feed roller gear and rotate said paper feed roller by said small angle in the reverse direction, and a restraint mechanism for restraining said angle gear at said rotated position against the force of said elastic member, the restraining force yielding to the driving force when said paper feed roller is driven by said normal rotation drive mechanism, whereby the restraint of said angle gear is released.

3. A device as claimed in claim 2, wherein said link mechanism has a projection moving in accordance with the actuation of said solenoid mechanism; said restraint mechanism includes a casing fixed to a machine frame, a restraint rod contained in said casing, said restraint rod being capable of sliding in a direction perpendicular to the direction of the movement of the projection of said link mechanism, and another elastic member for pressing said restraint rod so that a top end of said restraint rod is engaged with said projection; and wherein the pressing force of said another elastic member is stronger than the tensile force of said elastic member to disconnect said angle gear from said paper feed roller gear, but is weaker than the normal rotation driving force given to said paper feed roller and the attracting force of said solenoid mechanism.

4. A paper feed device for a copying machine, said device comprising:

a feed reel for supporting a copying paper wound thereon in a roll-like form;

a paper feed roller intermittently driven and rotated to take out said copying paper from said feed reel;

an introduction roller disposed on the introduction side of a transfer passage for delivering said copying paper to copying treatment zones in the copying machine;

a copying paper-cutting mechanism disposed between said paper feed roller and said introduction roller to cut said copying paper taken out of said feed reel into a prescribed length;

paper jamming-preventing mechanism means for stopping the front end of said copying paper, which is present at the cutting position when the operation of said paper-cutting mechanism is completed, at a position slightly retreated from said cutting position and for making the front end of the copying paper stand by for the next copying operation at this retreated position;

said feed roller having a clutch mechanism means for connecting said paper feed roller to a drive mechanism at the time of starting feeding of said copying paper and for releasing this connection prior to cutting of said copying paper;

said paper jamming-preventing mechanism means comprising a copying paper transfer passage-regulating mechanism disposed so that two copying paper transfer passages having differing passage lengths are formed between said paper feed roller and said cutting mechanism;

said copying paper transfer passage-regulating mechanism being disposed with such a positional relation to said paper feed roller that while said paper feed roller is driven, the roll-like copying paper is moved along the longer said transfer passage by the driving force given to said copying paper by said paper feed roller, and that when said feed roller is released from the connection with the drive mechanism, supply of roll-like paper from said feed reel is interrupted, and thereafter said paper feed roller is driven by said copying paper whereby said roll-like copying paper is shifted from said longer transfer passage to the shorter said transfer passage, and the roll-like copying paper continues to move along said shorter passage; and said cutting mechanism being actuated while said roll-like copying paper is delivered along said shorter transfer passage, said roll-like copying paper being shifted from said shorter transfer passage to said longer transfer passage after the cutting operation, whereby the front end of said roll-like copying paper is stopped and made to stand by at a position retreated from said cutting position by a distance corresponding to the difference of the length between said two transfer passages.

5. A device as claimed in claim 4, wherein said copying paper transfer passage-regulating mechanism includes a lower guide member having an inner face outwardly convex with respect to a line connecting the nip point of said paper feed roller and the cutting point of said copying paper-cutting mechanism; a regulating member disposed above said lower guide member so that it can swing across said line; and a receiving member means for receiving said regulating member when it is present at a position lowered by gravity; said longer copying paper transfer passage being formed between said lower guide member and said regulating member at said lowered position thereof; and wherein when said regulating member is pushed upwardly from said lowered position thereof by the tension on said copying paper present on said shorter transfer passage, and when said roll-like copying paper is cut, the front end of said roll-like copying paper is shifted from said shorter transfer passage to said longer transfer passage by the weight of said regulating member.

6. An electrophotographic copying machine comprising:

a paper feed device for feeding a roll-like copying paper;

a copying paper transfer passage including a zone of a charging device, a light exposure zone, a zone of a developing device and a zone of a drying or fixing device in the above recited sequence;

a moving frame having a transparent plate for supporting thereon an original to be copied;

an optical system fixed in the machine to optically connect said transparent plate of said moving frame to said light exposure zone of said transfer passage and to focus an image of the original supported on said transparent plate onto said copying paper travelling in said light exposure zone;

said paper feed device comprising a feed reel for supporting a copying paper wound thereon in a roll-like form; a paper feed roller intermittently driven and rotated by means of a clutch mechanism to take out said copying paper from said feed reel; an introduction roller disposed on the introduction side of said transfer passage; and a copying paper-cutting mechanism disposed between said paper feed roller and said introduction roller to cut said copying paper taken out of said feed reel into a prescribed length;

said moving frame including a cut length-designating mechanism for designating a cut length of said copying paper corresponding to a predetermined light exposure range of said original;

first detecting mechanism means provided adjacent the introduction end of said light exposure zone in said transfer passage to detect the forward end of the travelling copying paper, and to actuate first switch means so that the actuation of said first switch means is maintained while the copying paper is travelling;

second detecting mechanism means provided on a moving passage of said moving frame to detect said cut length-designating mechanism of said moving frame which is travelling along the moving passage of said moving frame and to actuate second switch means;

said first and second detecting mechanism means being disposed in such a positional relationship that when said moving frame moves from an exposure step initiating point by a distance ($l_x - l_{min}$) equal to the difference of the length ($l_x$) of said predetermined light exposure range from the distance ($l$min) between said cutting position and said first detecting mechanism means, said second detecting mechanism means detects said cut length-designating mechanism means, by actuation of said first switch means, the movement of said moving frame for the light exposure step is initiated and said paper feed roller is released from the connection with a drive mechanism therefor by means of said clutch mechanism and is driven idly, by actuation of both the first and second switch means, said copying paper-cutting mechanism is actuated to cut said copying paper in a length corresponding to the light exposure range length of the original to be copied while said copying paper is placed under a certain tension;

paper jamming-preventing mechanism means positioned in said paper feed device to stop the front end of said copying paper, which is present at the cutting position when the operation of said paper-cutting mechanism is completed, at a position slightly retreated from said cutting position and to make the front end of said copying paper stand by for the next copying operation at this retreated position;

said paper jamming-preventing mechanism means including a copying paper transfer passage-regulating mechanism disposed so that two copying paper transfer passages having differing passage lengths are formed between said paper feed roller and said cutting mechanism;

said copying paper transfer passage-regulating mechanism being disposed with such a positional relation to said paper feed roller that while said paper feed roller is driven, the roll-like copying paper is moved along the longer said transfer passage by the driving force given to said copying paper by said paper feed roller, and that when said feed roller is released from the connection with the drive mechanism, supply of roll-like paper from said feed reel is interrupted, and thereafter said paper feed roller is driven by said copying paper whereby said roll-like copying paper is shifted from said longer transfer passage to the shorter said transfer passage, and the roll-like copying paper continues to move along said shorter passage;

said cutting mechanism being actuated while said roll-like copying paper is delivered along said shorter transfer passage, said roll-like copying paper being shifted from said shorter transfer passage to said longer transfer passage after the cutting operation, whereby the front end of said roll-like copying paper is stopped and made to stand by at a position retreated from said cutting position by a distance corresponding to the difference of the length between said two transfer passages; and whereby, even if the transfer of said roll-like copying paper is started at a random position where the forward end of said roll-like copying paper is retreated from said cutting position, said copying paper can be cut precisely in a length corresponding to the desired copy length of the original.

* * * * *